US012256827B2

(12) United States Patent
Bowerman

(10) Patent No.: US 12,256,827 B2
(45) Date of Patent: Mar. 25, 2025

(54) MODULAR CLIPPING SYSTEM

(71) Applicant: Bowerbags LLC, Arlington, VA (US)

(72) Inventor: James Patrick Bowerman, Arlington, VA (US)

(73) Assignee: Bowerbags LLC, Savannah, GA (US)

( * ) Notice: Subject to any disclaimer, the term of this patent is extended or adjusted under 35 U.S.C. 154(b) by 18 days.

(21) Appl. No.: 17/885,303

(22) Filed: Aug. 10, 2022

(65) Prior Publication Data

US 2023/0047522 A1 Feb. 16, 2023

Related U.S. Application Data

(60) Provisional application No. 63/231,570, filed on Aug. 10, 2021.

(51) Int. Cl.
*A45F 5/00* (2006.01)

(52) U.S. Cl.
CPC ..... *A45F 5/00* (2013.01)

(58) Field of Classification Search
CPC ..... A45F 2005/026; A45F 5/021; A45F 5/02; Y10T 24/45262; F16B 2/245; F16B 45/06; F16B 45/035
USPC ..... 224/197, 255, 271–272
See application file for complete search history.

(56) References Cited

U.S. PATENT DOCUMENTS

| | | | | |
|---|---|---|---|---|
| 3,912,318 | A * | 10/1975 | Engh | B66C 1/36 24/599.2 |
| 4,697,946 | A | 10/1987 | Röck et al. | |
| 5,762,371 | A | 6/1998 | Noguchi | |
| 8,646,820 | B2 * | 2/2014 | Knox | F16B 45/026 294/82.15 |
| 8,827,127 | B2 * | 9/2014 | Rekuc | A45F 5/00 224/183 |
| 10,912,361 | B2 | 2/2021 | Wu et al. | |

OTHER PUBLICATIONS

International Search Report & Written Opinion for PCT/US2022/074774, dated Feb. 17, 2023, 5 pgs.

* cited by examiner

*Primary Examiner* — Adam J Waggenspack
(74) *Attorney, Agent, or Firm* — Thomas E. Lees, LLC

(57) ABSTRACT

A modular clipping system has a top cover, a midsection, a pull handle, and a base. The top cover has a plurality of elongated arms with a first cavity, the midsection forms a first portion of a second cavity, and the pull handle forms a second portion of the second cavity. The base forms a third cavity. The midsection, the pull handle, and the top cover are mated to the base such that the first cavity, the second cavity, and the third cavity are aligned, forming an opening. When the pull handle is activated, a male fitting is accepted into the opening and locked into the opening when the pull handle is released.

12 Claims, 13 Drawing Sheets

MODULAR CLIPPING SYSTEM

CROSS-REFERENCE TO RELATED APPLICATIONS

This application claims the benefit of U.S. Prov. App. No. 63/231,570, filed Aug. 10, 2021, the contents of which are incorporated by reference in their entirety.

FIELD OF THE INVENTION

This disclosure relates generally to a clipping apparatus and more particularly to a modular clipping system.

BACKGROUND OF THE INVENTION

Conventional bags and other devices used to carry equipment require clipping devices in order to ensure that additional equipment that does not fit in the bag itself can still be carried while leaving the user's hands free for other activities. Typical clipping devices such as carabiners do not hold items tightly to the surface, while other clipping devices are limited to the specific types of surfaces to which they can attach.

There is therefore a need in the art for clipping systems that are both secure and modular, such that one clipping system can be used for a variety of bags and accessories with different webbing sizes.

SUMMARY OF THE INVENTION

In accordance with an aspect of the present invention, the clipping system is comprised of a top cover, a midsection, a pull handle, and a base. The top cover is comprised of a plurality of elongated arms further comprising a first cavity, the midsection forms a first portion of a second cavity, and the pull handle forms a second portion of the second cavity. The base forms a third cavity. The midsection, the pull handle, and the top cover are mated to the base such that the first cavity, the second cavity, and the third cavity are aligned, forming an opening. When the pull handle is activated, a male fitting is accepted into the opening and locked into the opening when the pull handle is released.

In certain embodiments, the modular clipping system is designed to connect to webbing of any size and includes such systems and the Molle and PALS webbing system.

In certain embodiments, the male fitting of the clipping system is further comprised of a latching mechanism.

In certain other embodiments, the male fitting is also comprised of a suction cup and a peg attachment.

In yet other embodiments, activation of the pull handle increases a diameter of the opening.

BRIEF DESCRIPTION OF THE DRAWINGS

For the purpose of illustration, there are shown in the drawings certain embodiments of the present invention. In the drawings, like numerals indicate like elements throughout. It should be understood that the invention is not limited to the precise arrangements, dimensions, and instruments shown. In the drawings.

DETAILED DESCRIPTION OF THE INVENTION

Figure 1:
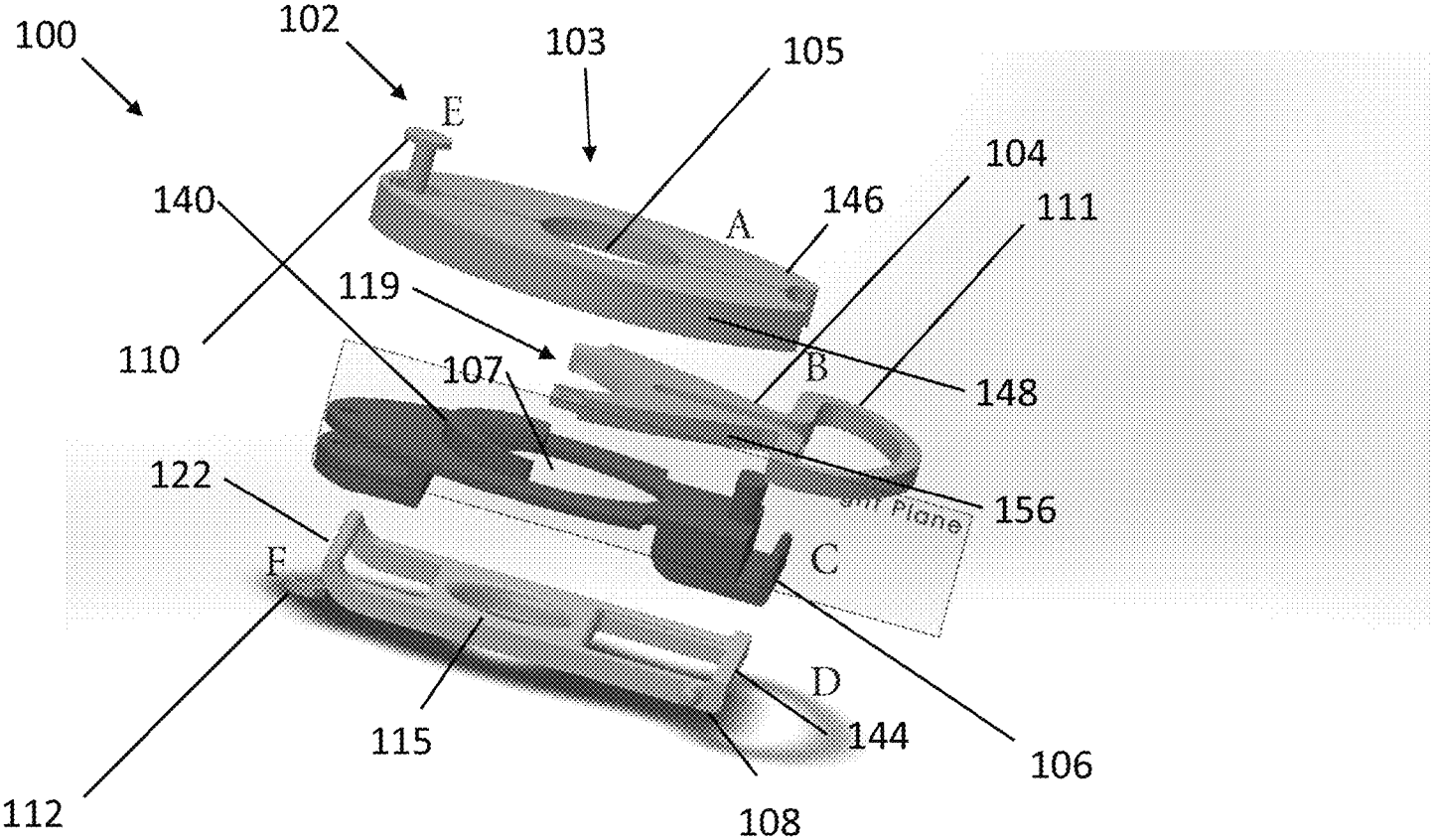
FIG. 1 is an exploded view of the clipping system.

Reference to the drawings illustrating various views of exemplary embodiments of the present invention is now made. In the drawings and the description of the drawings herein, certain terminology is used for convenience only and is not to be taken as limiting the embodiments of the present invention. Furthermore, in the drawings and the description below, like numerals indicate like elements throughout.

Figure 2:
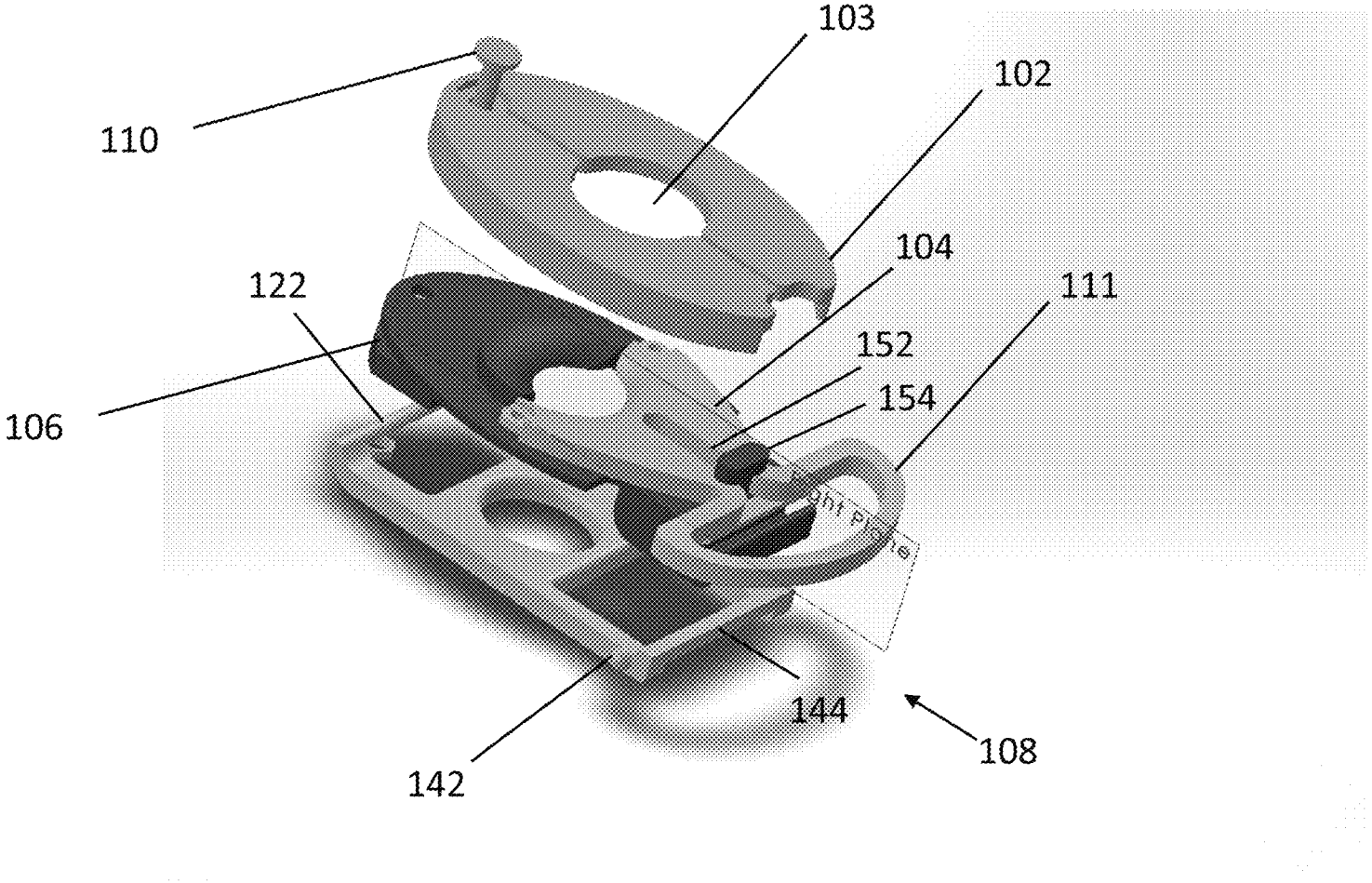
FIG. 2 is an exploded view of an exemplary embodiment of the clipping system with a pull handle.

FIGS. 1, 2 show an exploded view of the clipping assembly or clipping system 100. In certain embodiments, the system comprises a top cover 102, a locking mechanism 104 having a pull handle 111, a midsection 106, a base 108, a rivet or screw 110, and a nut 112. The top cover 102, locking mechanism, pull handle 111, midsection 106, and base 108 are relatively flat and have planar top and bottom surfaces, respectively.

In certain embodiments, the top cover 102 has a cover body that is comprised of two curved pieces or arms that are elongated in shape and are joined at a distal end by the screw 110, so that the pieces can pivot about the screw 110 between an opened position whereby the pieces are apart from each other, and a closed position whereby the pieces are together. The top cover 102 has a distal end that has a through-hole that retains the screw 110, and a distal end. The proximal end of each arm can have a projection that forms a grip and also forms a channel between the two arms when in the closed position. That enables the user to better grip the arms, if needed, and move the arms apart at the proximal end to pivot about the screw 110. The top cover 102 is a thin plate 146 that forms a top surface, and a downwardly turned side wall 148 that extends about the entire outer perimeter of the cover plate 146. The cover plate 146 is widest at the middle and curves inward at the distal end and at the proximal end.

The screw 110 passes through a through-hole in the cover 102 and a through-hole in the midsection 106, and is secured with a separate nut 112 that can be recessed at the midsection 106. While the screw 110 and the nut 112 are shown in this embodiment, it would be readily apparent to one of ordinary skill in the art that any type of fastener may be used to assemble the top cover 102, lock mechanism 104, midsection 106, and base 108.

The lock mechanism 104 has a lock mechanism body with a proximal end at which the pull handle 111 is formed, a central body portion, and a distal end having a curved, semi-circular leading edge that forms a first locking member or grip 119. The central body portion has a slit 152 that extends from the pull handle 111 partially toward the distal end. The midsection 106 has a cooperating tab 154 at the proximal end of the midsection 106. The tab 154 has a support or post that extends upward from the top surface of the midsection 106, and an elongated head that is wider than the post and extends in a direction transverse to the longitudinal axis of the midsection 106.

Figure 6:
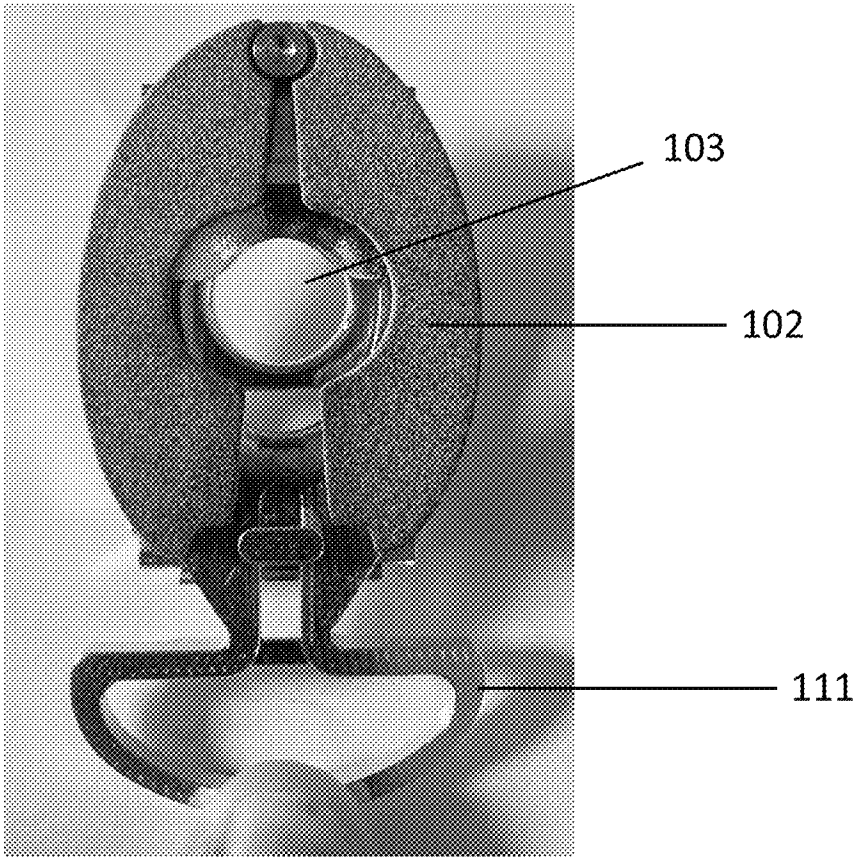
FIG. 6 is a top view of an exemplary embodiment of the clipping system with the pull handle activated.

To couple the lock mechanism 104 to the midsection 106, the lock mechanism 104 is first rotated approximately orthogonal to the midsection 106. The head of the tab 154 passes between and through the slit 152 so that the post is positioned in the slit 152 and the head is at the top surface of the lock mechanism 104 above the slit 152. The lock mechanism 104 is rotated approximately ninety degrees until the lock mechanism 104 is parallel to the midsection 106, thereby lockably coupling the lock mechanism 104 to the midsection 106, as best shown in FIG. 6. Since the elongated direction of the tab 154 is wider than the slit 152, the lock mechanism 104 cannot come free from the midsection 106.

The cover 102 is then placed on the midsection 106 so that the side wall 148 extends over the sides of the lock mechanism 104, enclosing the lock mechanism 104 between the cover 102 and the proximal portion fo the midsection 106. The cover side wall 148 can extend to the top surface of the midsection 106 or to the sides of the midsection 106. In addition, an elongated guide member can extend transversely inward from the bottom of the side wall 148 at the proximal end of the cover 102. The guide member is parallel to the bottom surface of the plate 146, to form a space between guide member and the plate 146 that receives the lock mechanism 104 and guides the lock mechanism 104 as it slides with respect to the cover 102 and the midsection 106.

The screw is 110 is then used to attach the cover 110 to the midsection 106, so that the lock mechanism 104 cannot escape the cover 102. In addition, the outward facing outer side wall 156 of the lock mechanism 104 is curved, and the inwardly facing inner wall 148 is curved in a similar direction. In some embodiments, the outward facing outer side wall 156 can have a same or similar shape as the inwardly facing inner wall 148 of the cover 103. Accordingly, when the user pulls on the handle 111, the outer side wall 156 of the lock mechanism 104 pushes outwardly on the inner wall 148 of the cover 103, thereby forcing the arms of the cover 102 apart.

The cover 102 has a cover opening 105, the midsection 106 has a midsection opening 107, and the base 108 has a base opening 115, which together form the central opening 103 of the clipping system 100. The cover opening 105, midsection opening 107, and base opening 115 can all be the same size or different sizes from one another, though in the embodiment shown the midsection opening 107 is larger than the cover opening 105 and the base opening 115.

Figure 5A:
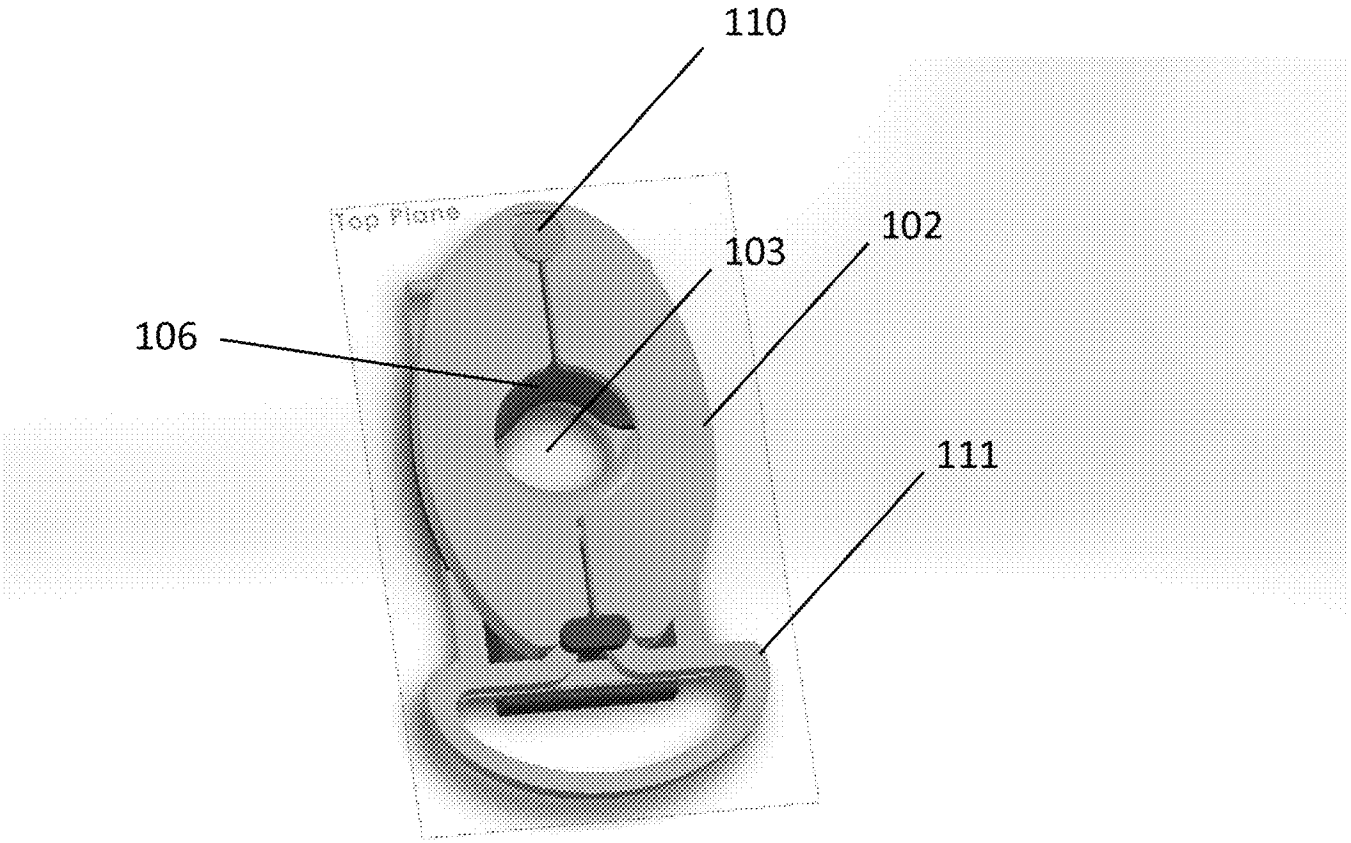
FIGS. 5A and 5B are top views of an exemplary embodiment of the clipping system in a closed position with all parts assembled.
Figure 5B:
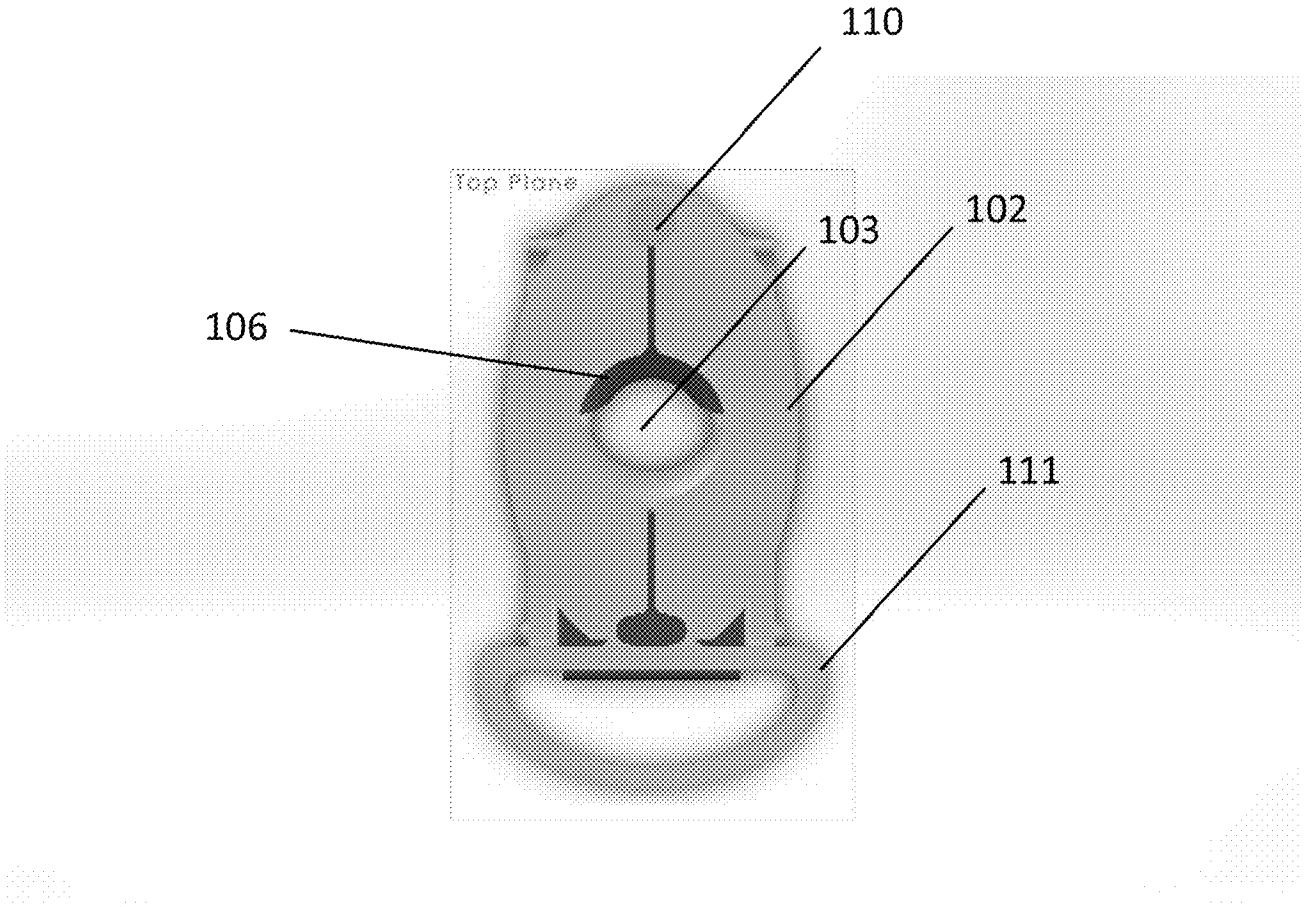

The midsection 106 has a midsection body with a top surface, a thickened distal portion, a thickened proximal portion, and an intermediate portion therebetween. A curved semi-circular projection forms a second locking member or grip 140 that projects upward from the top surface and extends forward toward the proximal end of the midsection 106. When the midsection 106 is aligned with the cover 102, the second grip 140 extends inwardly into the cover opening 105, as best shown in FIGS. 5A, 5B.

When the clipping system 100 is assembled, the base 108 and the lock mechanism 104 are set into the midsection 106. The top cover 102 is preferably molded to fit over the base 108 and the midsection 106. The pull handle 111 of the lock mechanism 104 protrudes from the midsection 106, as well as from the top cover 102 and base 108, such that the pull handle 104 is readily accessible to a user. In certain embodiments, the lock mechanism 104 is a unitary piece, preferably machined in metal, though it may also be fabricated from plastic or a combination of metal and plastic. When assembled, the lock mechanism 104 operates to expand and contract the central opening 103, which is substantially circular.

The lock mechanism 104 is slidably engaged with the midsection 106 so that it moves between a locked position and an unlocked position. In the locked position, the lock mechanism 104 is at an inward position whereby the distal end of the lock mechanism 104 extends partially into the midsection opening 107, as well as the cover opening 105, to partially block the midsection opening 107 and cover opening 105, and whereby the leading edge 119 partially extends into the midsection opening 107 and the cover opening 105.

The first grip 119 and the second grip 140 cooperate to releasably lock the system 100 to a male peg member 113 (FIG. 7) that is received in the opening 103. The first grip 119 aligns with the second grip 140 at the top surface of the midsection 106. In the locked position, the first and second grips 119, 140 each independently extend below a protruding head of a male peg 113 that is received in the central opening 103 to removably lock or couple the peg 113 to the assembly 100. A bottom surface of the lock mechanism distal end is flat, and the bottom surface of the midsection 106 at the second grip 140 is flat, so that they lockably engage the flat underside of the head portion of the peg 113. The top surface of the first and second grips 119, 140 can each be beveled, whereby the top surface is curved downward and inward to provide a curved surface. The lock mechanism 104 is pushed outward with respect to the midsection 106 by the rounded head of the male fitting 113 as it is received in the central opening 103 and the rounded head presses the curved first and second grips 119, 140 outward. In the unlocked position, the lock mechanism 104 is at an outward position whereby the central opening 103 is substantially or fully unobstructed by the lock mechanism 104 and the first grip 119 and/or the second grip 140 is outside of the midsection opening 107 and/or central opening 103.

The lock mechanism 104 is preferably under tension so that at rest the lock mechanism is in the locked position. For example, a spring can be positioned between the two arms of the cover to pull the two arms together, and the two arms apply an inward bias to the lock mechanism 104 via the cover side wall 148 contacting the lock mechanism side wall 156. The top cover 102 is comprised of two elongated arms, with the cover central opening 105 in between. The arms of the top cover 102 are fastened by the screw 110 and the nut 112 (or other fastener) such that when the pull handle 104 is pulled outwards, the arms of the top cover 102 flex against the lock mechanism 104, creating tension while expanding the diameter of the central cover opening 105. Once the pull handle 111 is released, the tension is released so that the arms of the top cover 102 return to their original position and the cover central opening 105 contracts to its original diameter in the closed position. In an alternate embodiment, the bias to the locked position can be achieved by a spring that is positioned between the lock mechanism 104 and the midsection 106.

Thus, the cover opening 105 is wider than the head of the peg 113. In the closed position, the midsection opening 106 (formed by the first and second grips 119, 140), is smaller than the head of the peg 113 but larger than the support post of the peg 113. In the opened position, the midsection opening 106 is larger than the head of the peg 113 so that the peg can be received in the midsection opening 106. In operation, the user can press the rounded peg head into the first and second grips 119, 140, which forces the grips 119, 140 apart into the opened position. In addition (or alternatively), the user can pull on the handle 111 to force the arms apart and position the grip 119 in an opened position.

Figure 3:
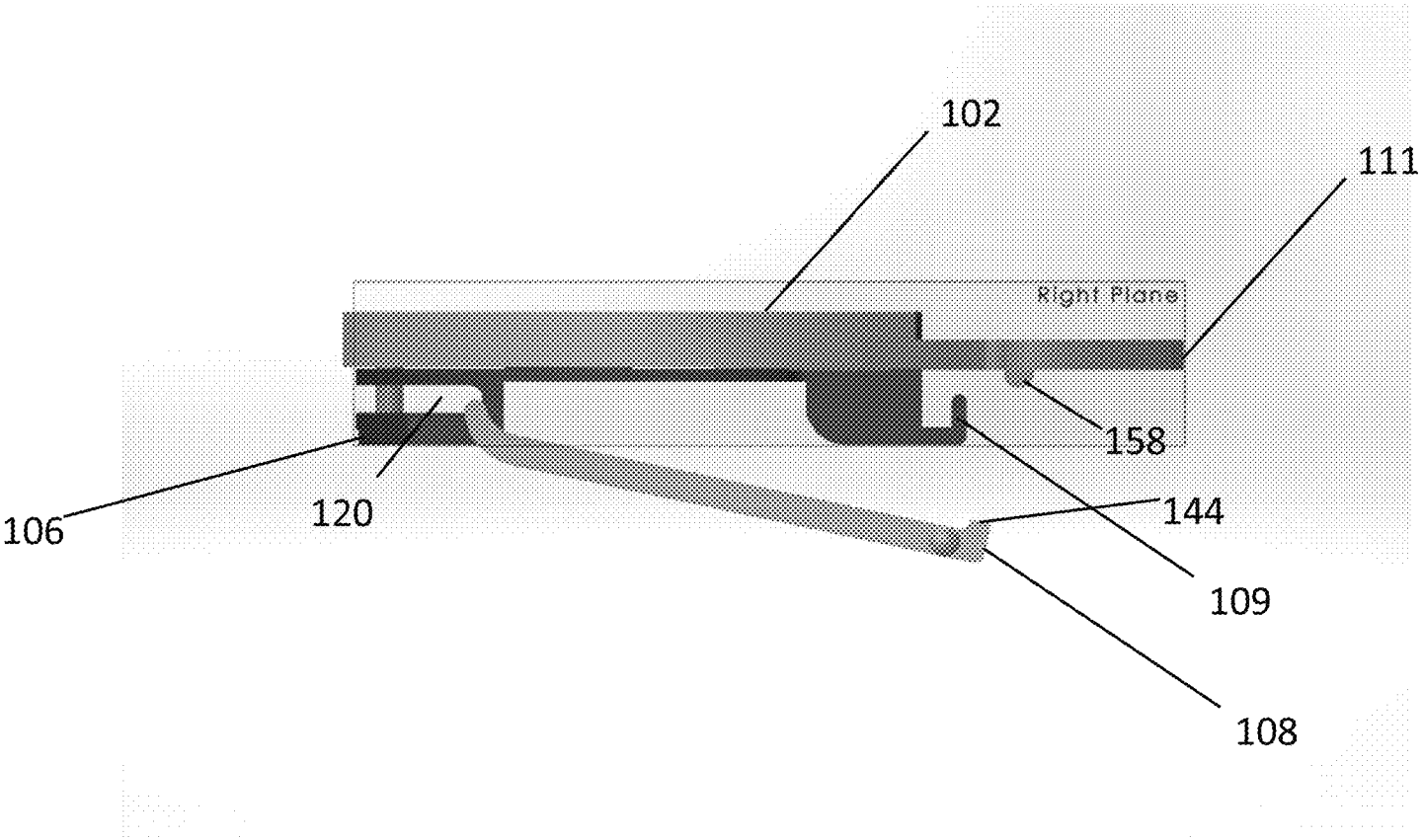
FIG. 3 is a side view of an exemplary embodiment of the clipping system in an open position to attach to Molle webbing.
Figure 4:
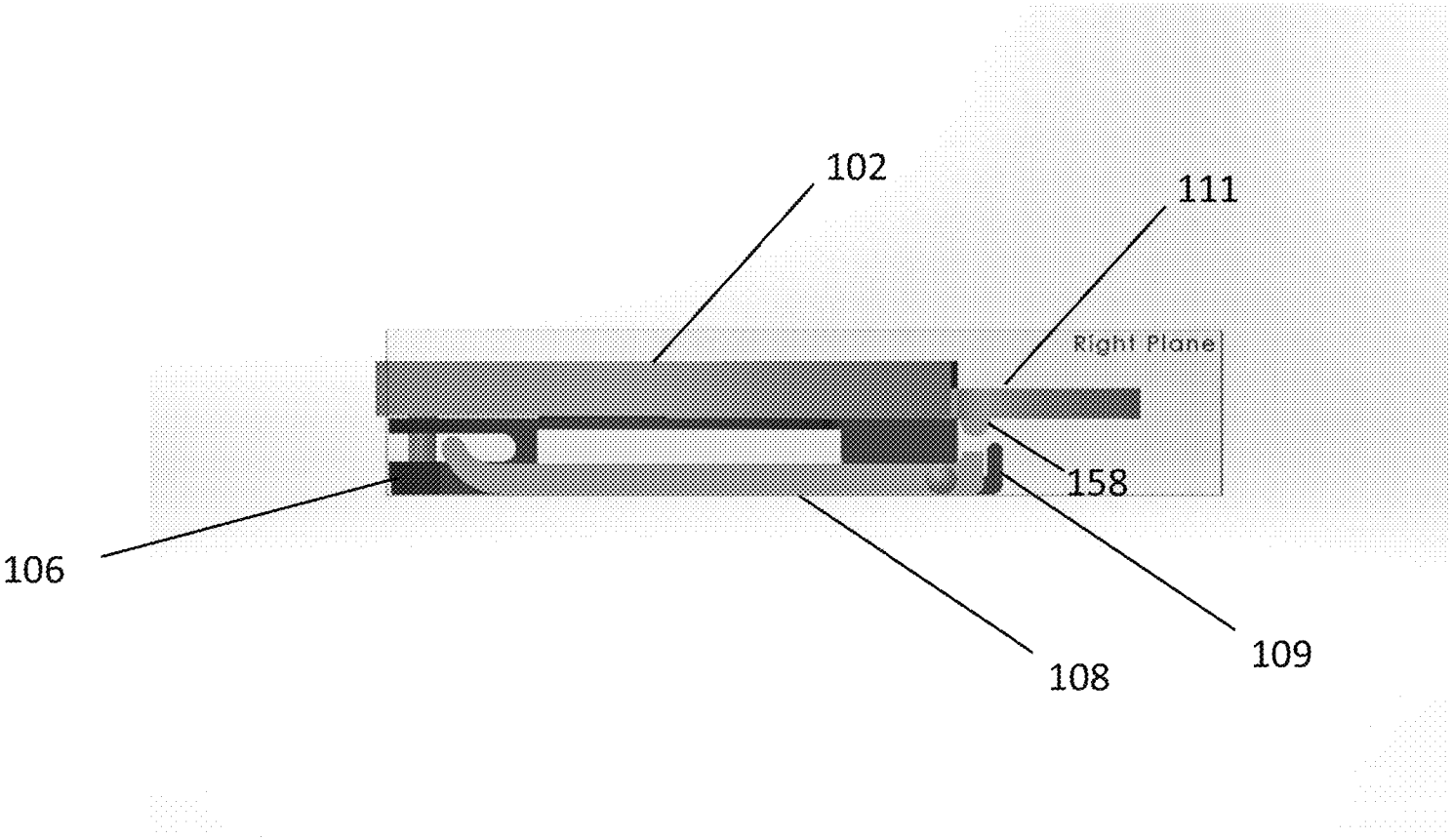
FIG. 4 is a side view of an exemplary embodiment of the clipping system in a closed position to attach to Molle webbing.

FIGS. 3 and 4 show a side view of an exemplary embodiment of the clipping system 100 in opened and closed positions, respectively. The base 108 is slidably and pivotally coupled to the midsection 106. More specifically, as illustrated, the midsection 106 has a thick distal portion and an elongated slot 120 is formed in the midsection distal portion so that the slot 120 extends from the distal edge inward. Thus, the slot 120 is substantially parallel to the longitudinal axis of the system 100. The proximal portion of the midsection 106 is also thickened and has a reverse J-shaped hook 109 extending outward with respect to the thickened proximal end of the midsection 106.

The base 108 can unlatch from and latch to the hook 109 to allow for the clipping system 100 to attach to a strap or webbing, for example, Molle webbing, when in the closed position. The base 108 has a distal portion with a distal portion opening and a proximal portion with a proximal portion opening. The distal portion opening aligns with and receives the thickened distal portion of the midsection 106, and the proximal portion opening aligns with and receives the thickened proximal portion of the midsection 106.

Figure 10:
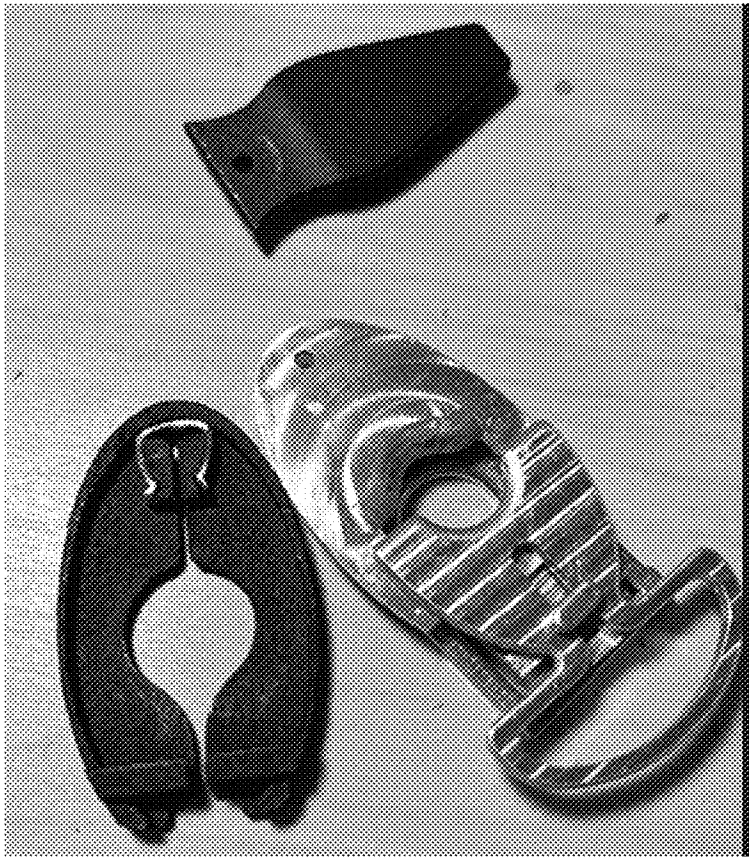
FIG. 10 shows an adapter.

The base 108 has a body formed by two parallel frame members, a rod member 122 at a distal end, a support member 144 at a proximal end, and a platform at the intermediate portion between the distal end and the proximal end. The rod member 122 extends at the distal end of the base 108 substantially transverse to the base 108 and orthogonal to the longitudinal axis. A support bar 144 (e.g., having a square cross section) extends at the proximal end of the base 108 substantially transverse to the base 108 and orthogonal to the longitudinal axis. The base 108 is flat, except that it extends upward at the distal end to the rod 122 so that the rod 122 can be positioned in the slot. The rod 122 is received in the channel 120 of the midsection 106, and can slide from a proximal end of the channel 120 to the distal end of the channel 120. The screw 110 prevents the rod 122 from escaping the channel 120. In addition, an optional adapter (FIG. 10) can be rotationally or fixedly fitted to the channel 120 and retained by the screw 110; whereby the adapter can connect to another device. The adapter can have a forward edge that can be rotated to selectively engage the rod 122 to push the base 108 forward. The support member 144 is removably received in the channel of the J-shaped hook 109 (FIG. 3).

As further shown in FIGS. 3, 4, the distal end of the base 108 is pivotally coupled by the rod 122 and channel 120 to the midsection 106, at the distal end of the midsection 106, and the distal end of the base 108 can be set inward with respect to the distal edge of the midsection 106. When in the open position, as shown in FIG. 3, the base 108 pivots outward and away from the midsection 106. In the opened position, the base 108 is at the forwardmost proximal portion of the slot 120, and the base 108 can be fastened to the hook 109 to enter the closed position shown in FIG. 4. More specifically, the base 108 comes forward in the slot 120 (either by hand or by operation of the optional adapter pushing forward on the rod 122) so that the support member 144 extends past the forwardmost lip of the hook 109. The base 108 is then raised so that the support member 144 is above the forwardmost lip of the hook 109. The base 108 is then pushed rearward in the slot 120 and the support member 144 enters the channel formed in the hook 109 behind the lip.

As further shown in FIGS. 3, 4, a stop member 158 protrudes outward from the bottom surface of the handle 111 or lock mechanism. When the lock mechanism is in the closed position (FIG. 4), the stop member 158 is aligned with the channel of the hook 109 and prevents the support member 144 cannot escape the hook channel. When the lock mechanism is in the opened position (FIG. 3), the stop member 158 is not aligned with the channel of the hook 109, so that the support member 144 can be inserted and/or removed from the channel of the hook 109.

The base 108 can thereby be opened, a strap, webbing or other material can be inserted, and then the base 108 closed. It is noted that in certain embodiments, the peg 113 does not enter the center base opening 115, and the center base opening can be optional. However, in some embodiments the peg 113 presses the strap against the base opening 115 to fix the strap in position.

The hook 109 shown is an exemplary configuration of the present technology, and one of ordinary skill would readily understand that other means of fastening may be used to allow the base 108 to attach to the midsection 106 and adopt the closed position shown in FIG. 4.

FIGS. 5A, 5B each show a top view of the clipping system in the closed position with all components assembled. As shown, the lock mechanism 104 is in its resting position, such that the lock mechanism 104 projects into and is visible in the cover opening 105. In the closed position, the midsection 106 has elements that operate to reduce the diameter of the central opening 103 to return it to its original diameter when in its closed position. For example, a spring member can be positioned at the distal end of the cover to bias the arms to the closed position, for instance the spring can connect to each arm at the underside of the plate 146.

FIG. 6 is a top view of an exemplary embodiment of the clipping system with the locking mechanism 104 activated. The pull handle 111 of the lock mechanism 104 operates to expand and contract the central opening 103, such that the central opening 103 expands to allow for mating with the male fitting or peg 113 (FIG. 7) of the top portion 114 of the peg system 100. As shown in FIG. 6, the arms of the top cover 102 are pushed outwards when the pull handle 104 is activated. That, in turn, expands the diameter of the central opening 103 so that it is capable of mating with the male fitting or peg 113. At the same time, the stop member 158 moves out of alignment with the channel of the hook 109 so that the base 108 can be removed from the hook 109.

Figure 7:
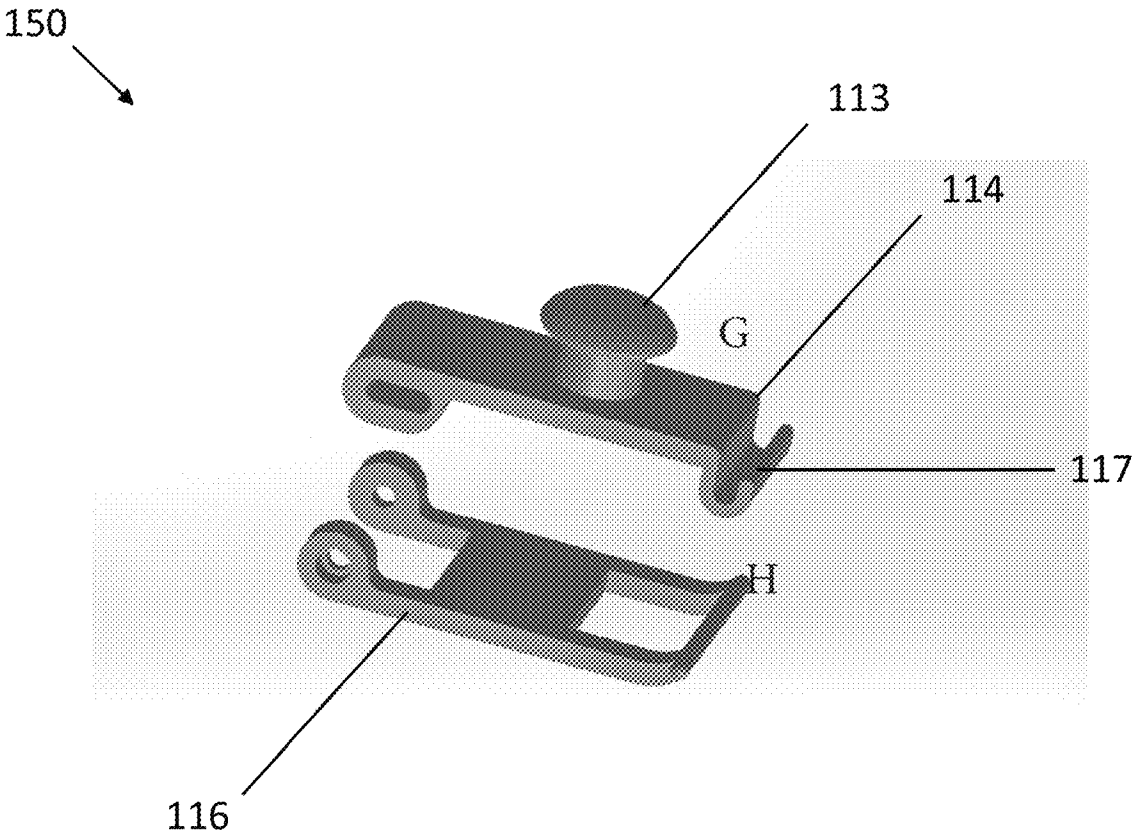
FIG. 7 is an exploded view of the peg system of the clipping system in accordance with an exemplary embodiment.
Figure 8A:
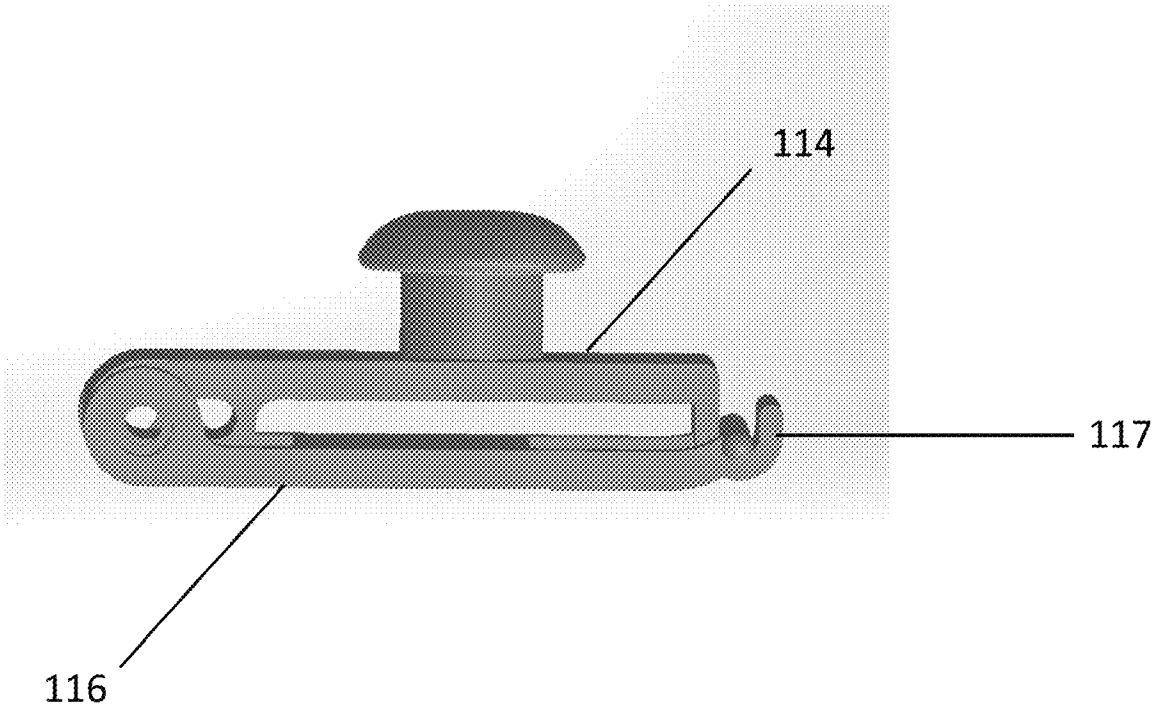
FIG. 8A is a side view of the closed peg system of the clipping system.
Figure 8B:
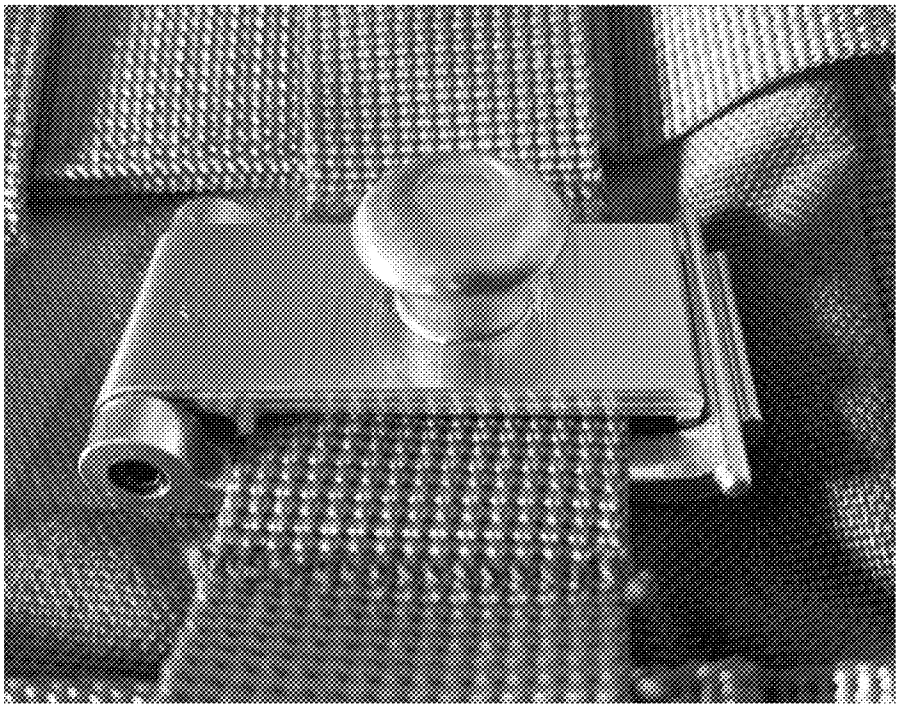
FIG. 8B is an image of the closed peg system of the clipping system on Molle webbing.

FIG. 7 is an exploded view of the peg system 150 of the clipping system 100 in accordance with an exemplary embodiment. The peg system 150 of the clipping system 100 has a top member 114 and a bottom member 116. The top member 114 and the bottom member 116 mate together to form a closed configuration, as shown in FIGS. 8A, 8B. FIG. 8A is a side view of the closed peg system of the clipping system, while FIG. 8B is an image of the closed peg system of the clipping system on a strap or Molle webbing. In certain embodiments, the bottom member 116 mates to a latch 117 at the top member 114 of the peg system. The top portion 114 of the peg system is also comprised of a male fitting or peg 113 which fits and mates with the clipping system through the central opening 103. As shown, the peg 113 has a support and a widened head with a curved top and a flat ledge between the support and the head.

The top member 114 has a distal portion that is thickened and has an elongated slot that extends transversely through the top member 114. The latch 117 is formed at the proximal end of the top member 114 and has a reverse J-shape. The bottom member 116 has a distal end with two arms and transverse through-holes. A screw(s) extends from the first transverse through-hole, through the elongated slot, and engages a nut contained in the second transverse through-hole, to thereby pivotally connect the bottom member 116 to the top member 114. A support member is positioned at the proximal end of the bottom member 116 and extends transversely across the bottom member 116. The support member is removably received in the latch 117. The bottom 116 also has a center cross-member with openings at the distal portion and proximal portion.

Figure 9:
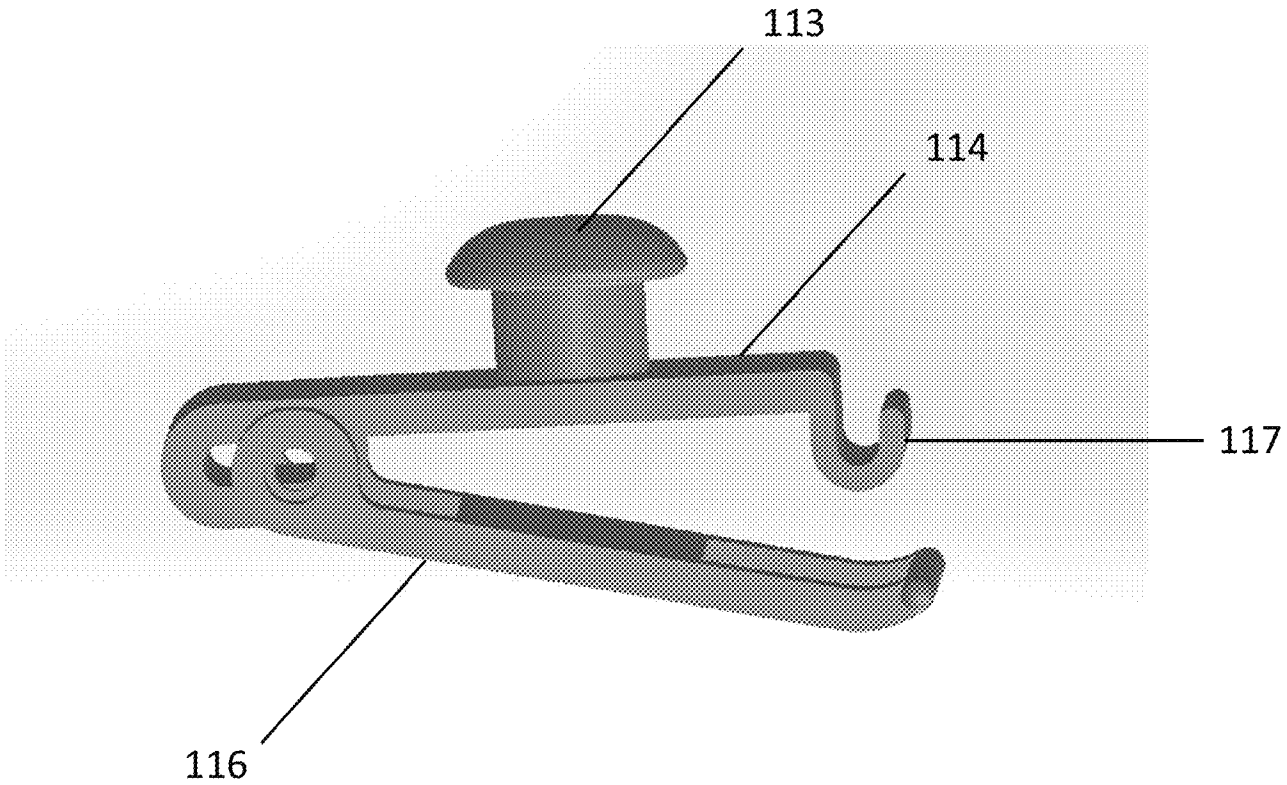
FIG. 9 is a side view of the peg system of the clipping system in an open position.

To close the peg system 150 FIGS. 8A, 8B), the bottom member is slid forward in the elongated slot, the support member is moved upward, then rearward in the slot, and enters the channel of the latch 117. The top portion 114 and the bottom portion 116 each have a flat intermediary portion between the distal and proximal ends, respectively, that are parallel to one another. In the closed position, the strap forces the bottom portion 116 outward, which in turn retains the support member in the latch 117 and prevents the support member from inadvertently escaping the latch 117. To open the system 150 (FIG. 9), the reverse process is employed. FIG. 9 is a side view of the peg system of the clipping system in an open position. As shown, the bottom portion 116 is disengaged from the latch 117 of the top portion 114. In other embodiments, the latch 117 can be recessed from the distal edge of the top plate, so that there is an overhang that extends over the latch 117 and has a downwardly turned lip that extends down toward the latch with a gap between the latch and the lip. The overhang further prevents the support member from escaping the latch 117, such as due to bumping into an object.

In certain embodiments, there may be a cavity in the male fitting or peg 113 so that a magnetic connection can be made to guide and connect the male fitting or peg 113 and the base 108 with the clipping system securing the connection to increase the weight and load tolerances. In yet other embodiments, there may be a suction cup or a magnet on the face of the male fitting or peg 113 opposite from its connection to the rest of the clipping system. The suction cup or magnet can then be used to form a secure connection to various surfaces. For example, the peg 113 can be attached to or integrated with a body that also includes a magnet and/or a suction cup.

Figure 11A:
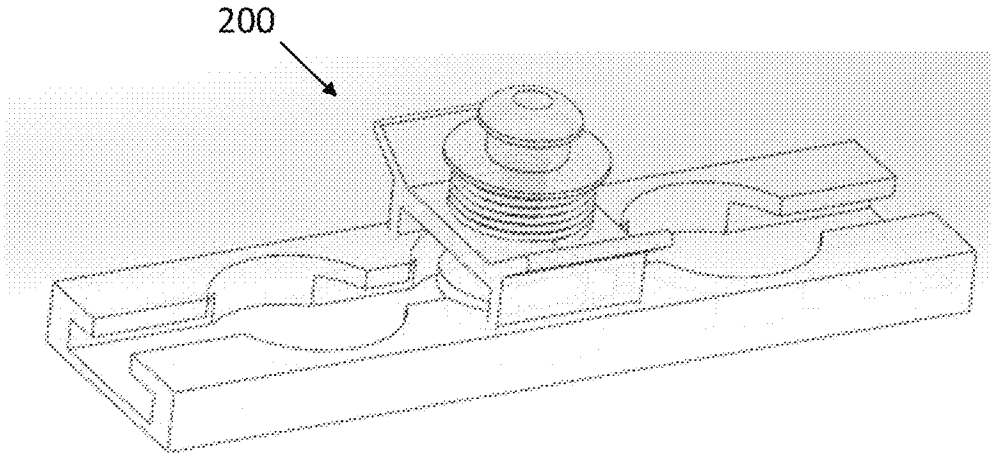
FIGS. 11A, 11B, 11C show another example embodiment of a peg system for use with a track.
Figure 11C:
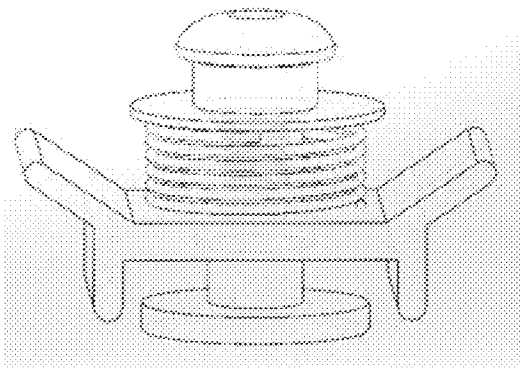
Figure 11B:
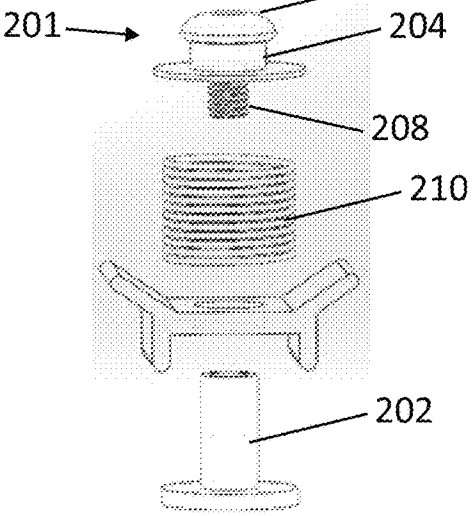

Another embodiment of the peg system 200 is shown, for example in FIGS. 11A, 11B, 11C, here implemented in a stud fitting that removably locks to a vehicle L-track apparatus. The stud fitting has a post 202 that extends through a body 204. The post 202 is a tube having a bottom end with a foot formed as a disc that engages the L-track. A top end of the post 202 is open and has female portion formed by an internally threaded opening. A peg device 201 has a middle section forming a support portion 204, a widened head 206 at a first end, and a threaded male portion 208 at a second end opposite the first end. The peg device 201 is a single unitary piece. A washer is placed about the threaded male portion 208, then the male portion 208 is passed through a spring 210 and into the female threaded portion of the post 202. The peg device 201 can then be coupled to the clip system 100 as noted above. Though the peg system 200 is shown connected to an L-track, it can instead be connected to a bracket or other device.

The system is modular in that the clipping system 100 can be readily connected with any device having a male fitting 113, and can be removably connected with any webbing or strap device, such as for example as shown in FIGS. 7-9, 11, magnets, brackets, and suction cups.

In one embodiment, the peg system 150 can be aluminum; the locking mechanism, base and midsection can be metal; and the cover can be hardened molded plastic. Various alterations in the design of any of the foregoing components of the clipping system may be made to accommodate a blend of materials such as metals and plastics to increase strength and max force loads.

It is further noted that the description and claims use several geometric or relational terms, such as circular, curved, planar, linear, elongated, rounded, and flat. In addition, the description and claims use several directional or positioning terms and the like, such as top, bottom, inwardly, outwardly, inner, outer, distal, and proximal. Those terms are merely for convenience to facilitate the description based on the embodiments shown in the figures, and are not intended to limit the invention. Thus, it should be recognized that the invention can be described in other ways without those geometric, relational, directional or positioning terms. In addition, the geometric or relational terms may not be exact. For instance, walls or surfaces may not be exactly circular to one another but still be considered to be substantially circular because of, for example, roughness of surfaces, tolerances allowed in manufacturing, etc. And, other suitable geometries and relationships can be provided without departing from the spirit and scope of the invention.

These and other advantages of the present invention will be apparent to those skilled in the art from the foregoing specification. Accordingly, it is to be recognized by those skilled in the art that changes or modifications may be made to the above-described embodiments without departing from the broad inventive concepts of the invention. It is to be understood that this invention is not limited to the particular embodiments described herein, but is intended to include all changes and modifications that are within the scope and spirit of the invention.

The invention claimed is:

1. A clipping apparatus comprising:

a top cover comprised of a plurality of elongated arms situated adjacent one another to define a top cover upper surface and which are pivotably secured to one another to define between them a cover opening for receiving a male fitting;

a midsection having a first grip;

a base pivotally attached to the midsection to define a strap-receiving or webbing-receiving slot therebetween; and a locking mechanism having a second grip aligned with the first grip to form a locking opening therebetween, said locking mechanism slidably coupled to said midsection and having an open position in which the second grip is at a farther position from the first grip and a closed position in which the second grip is at a closer position to the first grip.

2. The clipping apparatus of claim 1, wherein in the open position, said locking opening is wider than the male fitting to receive the male fitting between the first and second grips.

3. The clipping apparatus of claim 1, wherein in the closed position, said locking opening is smaller than the male fitting to lock the male fitting between the first and second grips.

4. The clipping apparatus of claim 2, wherein the male fitting comprises a peg having a support and a widened head, wherein the support fits between the first and second grips in the closed position.

5. The clipping apparatus of claim 2, wherein the male fitting is configured to attach to a strap or webbing.

6. The clipping apparatus of claim 1, said locking mechanism further comprising a pull handle configured to open the plurality of arms of said cover and a diameter of the cover opening is expanded.

7. The clipping apparatus of claim 1, further comprising a fastener coupling said cover to said midsection.

8. The clipping apparatus of claim 7, wherein the fastener comprises a screw and a nut.

9. The clipping apparatus of claim 1, wherein said clipping apparatus is comprised of at least one of plastic and metal.

10. The clipping apparatus of claim 1, said base having a distal end comprising a pivot member pivotally coupled to said midsection, and a proximal end having a support member that releasably couples to said midsection.

11. The clipping apparatus of claim 10, wherein said pivot member comprises a rod transversely extending at a distal portion of said base.

12. The clipping apparatus of claim 10, said locking mechanism having a stop member aligned with said support member in the closed position to lock said support member to said midsection and offset from said support member in the open position to release said support member from said midsection.

* * * * *